US005330712A

United States Patent [19]

Singh

[11] Patent Number: 5,330,712

[45] Date of Patent: Jul. 19, 1994

[54] COPPER-BISMUTH ALLOYS

[75] Inventor: Akhileshwar R. Singh, Bedford, Ohio

[73] Assignee: Federalloy, Inc., Bedford, Ohio

[21] Appl. No.: 63,435

[22] Filed: May 18, 1993

Related U.S. Application Data

[63] Continuation-in-part of Ser. No. 51,161, Apr. 22, 1993, abandoned.

[51] Int. Cl.[5] ..... C22C 9/02

[52] U.S. Cl. ..... 420/473; 420/471; 420/472; 420/476; 148/412; 148/433

[58] Field of Search ..... 420/473, 476, 471, 472, 420/475, 481; 148/412, 433, 413, 434; C22C 9/02, 9/04

[56] References Cited

U.S. PATENT DOCUMENTS

| | | | |
|---|---|---|---|
| 1,959,509 | 5/1934 | Tour | 420/481 |
| 4,708,739 | 11/1987 | Kellie et al. | 420/469 |
| 4,879,094 | 11/1989 | Rushton | 420/476 |
| 4,879,096 | 11/1989 | Naton | 420/561 |
| 4,915,908 | 4/1990 | Nagle et al. | 420/590 |
| 4,929,423 | 5/1990 | Tucker et al. | 420/561 |
| 5,102,748 | 4/1992 | Wylam et al. | 428/647 |
| 5,118,341 | 6/1992 | Daver et al. | 75/231 |
| 5,127,332 | 7/1992 | Corzine et al. | 102/509 |
| 5,137,685 | 8/1992 | McDevitt et al. | 420/477 |
| 5,167,726 | 12/1992 | LoIacono et al. | 148/432 |

FOREIGN PATENT DOCUMENTS

| | | |
|---|---|---|
| 54-135618 | 10/1979 | Japan . |
| 57-73149 | 5/1982 | Japan . |
| 57-73150 | 5/1982 | Japan . |
| 57-76142 | 5/1982 | Japan . |
| 63-266053 | 11/1988 | Japan . |
| 0519597 | 4/1940 | United Kingdom . |

*Primary Examiner*—R. Dean
*Assistant Examiner*—Sean Vincent
*Attorney, Agent, or Firm*—Thompson, Hine and Flory

[57] ABSTRACT

An alloy consisting essentially of about 0.1 to 7% bismuth, up to about 16% tin, up to about 25% zinc, up to about 27% nickel, about 0.1 to 1% mischmetal and the balance copper and incidental impurities.

10 Claims, 3 Drawing Sheets

COPPER-BISMUTH ALLOYS

CROSS REFERENCE TO RELATED APPLICATIONS

This is a continuation-in-part of U.S. application Ser. No. 08/051,161, filed Apr. 22, 1993, now abandoned.

BACKGROUND OF THE INVENTION

The present invention relates generally to copper-bismuth alloys and, more particularly, to virtually lead-free copper base alloys which can be substituted for conventional leaded brasses in plumbing fixtures and other applications.

Lead, as part of traditional copper base alloys, provides two major benefits, namely, improved pressure tightness and easy machinability. Because the solubility of lead in the copper matrix upon freezing at room temperature is 50 parts per million (0.005%), it has a tendency to segregate into areas which freeze last. As a result, it will fill in any voids which may exist in the casting thereby improving pressure tightness.

Also, in copper base alloys, the distribution of lead is nonuniform in nature. This segregation of lead aids the machinability index because the tool will touch the lead-rich surfaces in the casting thereby making it easier to form small chips with ease. The presence of lead in copper base castings also makes them much easier to polish which is highly desirable as many plumbing fixtures are plated with chrome.

Nevertheless, despite the favorable casting characteristics described above, the presence of lead in castings to which people may be exposed and which are also presently utilized in a variety of manufacturing processes has created far more serious problems in the areas of health as it relates to ambient air, potable water, and the soil system. These problems are currently and forthrightly being addressed by the Occupational, Safety and Health Administration (OSHA), the Environmental Protection Agency (EPA), and both Houses of Congress.

As a consequence, OSHA is requiring all foundries that employ more than 20 people to reduce their plant ambient air levels to 50 μg of lead per cubic meter of air from the present standard of 200 μg by July 1996. This will cause millions of dollars to be spent on unproductive equipment at the affected businesses in the coming years. Currently, the EPA is moving toward reducing the lead leaching standard in drinking water from 50 μg/L, its present level, all the way down to possibly as low as 5 μg/L. Both Houses of Congress are considering a variety of measures dealing with this issue.

While the affected industries have made substantial efforts to develop a lead-free alloy, currently no such alloy is being used which is technologically feasible or economically viable in the ways discussed below. To be commercially viable, this alloy must possess acceptable castability, machinability, solderability, plateability, and resistance to corrosion characteristics. It would also be highly beneficial to all foundries if the desirable lead-free alloy could also be cast in a similar fashion to the present leaded alloys thereby eliminating the need for worker training or the purchase of new equipment. Finally, it would be highly desirable if the scrap generated from the production and use of these lead-free castings would not contaminate the scrap of the presently used leaded copper base alloys, if mixed. This would have tremendous appeal to the recycling industry—a highly beneficial and growing industry in the U.S.

One approach that has been taken to provide lead-free copper alloys is to substitute bismuth for the lead in the alloy composition. Bismuth, which is adjacent to lead in the Periodic Table, is non-toxic. It is virtually insoluble in the solid state and precipitates as pure globules during freezing in a copper base alloy. When alloyed with copper, bismuth produces a course grain size that promotes shrinkage porosity. For many years it has been recognized that bismuth is brittle as cast in copper base alloys. Nevertheless, some success with lead-free or substantially lead-free bismuth-containing copper alloys has been reported in the patent literature.

U.S. Pat. No. 4,879,094 to Rushton discloses a cast copper alloy which contains 1.5 to 7% bismuth, 5 to 15% zinc, 1 to 12% tin and the balance essentially copper.

Japanese Published Applications 57-73149 and 57-73150 to Hitachi disclose copper alloys containing bismuth which are characterized by additions of graphite and titanium or manganese. Chromium, silicon, or mischmetal may be added to the alloy.

U.S. Pat. No. 5,167,726 to AT&T Bell Laboratories discloses a wrought copper alloy containing bismuth and phosphorous, tin or indium.

U.S. Pat. No. 5,137,685 discloses a copper alloy in which the lead content is reduced by the addition of bismuth. The alloy nominally contains 30 to 58% zinc. To improve its machinability, a sulfide, telluride, or selenide may be added to the alloy or, to enhance the formation of sulfides, tellurides and selenides, an element which combines with them such as Zirconium, manganese, magnesium, iron, nickel or mischmetal may be added.

U.S. Pat. No. 4,929,423 discloses a lead-free solder containing 0.08 to 20% bismuth, 0.02 to 1.5% copper, 0.01 to 1.5% silver, 0 to 0.1% phosphorous, and 0 to 20% mischmetal and the balance tin.

The cost of alloys containing large quantities of bismuth is another concern because bismuth is much more expensive than lead. Questions arise concerning the cost compatibility of bismuth containing alloys as substitutes for leaded alloys. If bismuth-containing lead-free alloys are too expensive, industry may adopt less satisfactory substitutes such as plastic. While there have been numerous attempts to provide low lead or lead-free copper base alloys, to date, none have proven to be commercially successful.

SUMMARY OF THE INVENTION

It has now been found that lead-free copper base alloys having properties comparable to leaded copper base alloys can be obtained from bismuth-containing copper base alloys which contain mischmetal or its rare earth equivalent. It has been found that the addition of mischmetal or its rare earth equivalent to bismuth-containing copper alloys refines the grain and promotes the uniform distribution of bismuth in the copper matrix and provides an alloy which can be readily substituted for its leaded counterpart.

Accordingly, the present invention provides a lead-free copper alloy which comprises about 0.1 to 7.0% bismuth, about 0 to 16% tin, about 0 to 25% zinc, up to 27% nickel, about 0.1 to 1% mischmetal and the balance being essentially copper and incidental impurities.

In a more preferred embodiment of the invention, the alloys comprise about 2 to 4% bismuth, about 2 to 6% tin, about 4 to 10% zinc, about 0.5 to 1% nickel, about 0.1 to 0.5% mischmetal and the balance copper and incidental impurities. The alloys may also contain small amounts of elemental additives commonly present in copper-base casting alloys.

Another manifestation of the invention is low lead or lead-free, low bismuth alloys. It has been found that with the addition of mischmetal or its rare earth equivalent, the bismuth content of an alloy can be held to less than 1% and more particularly to about 0.6 to 0.9% and castable alloys having satisfactory machinability and pressure tightness can be obtained.

Still another manifestation of the invention is low tin alloys wherein any of the aforementioned alloys may be modified to contain less than 1% tin. These low tin alloys contain nickel; typically the nickel is present in an amount of about 1 to 8%.

A further manifestation of the invention is alloys which are substitutes for leaded nickel silver alloys. These alloys contain about 1.5 to 5.5% tin, up to about 25% zinc, about 0.1 to 7.0% bismuth, about 11 to 27% nickel, up to 1% manganese, about 0.1 to 1% mischmetal and the balance copper and incidental impurities. More particularly, these alloys may contain 2 to 7% bismuth or they may be prepared as low bismuth alloys containing about 0.6 to 1.5% bismuth and more particularly 0.6 to 0.9% bismuth.

DETAILED DESCRIPTION OF THE INVENTION

Figure 1:
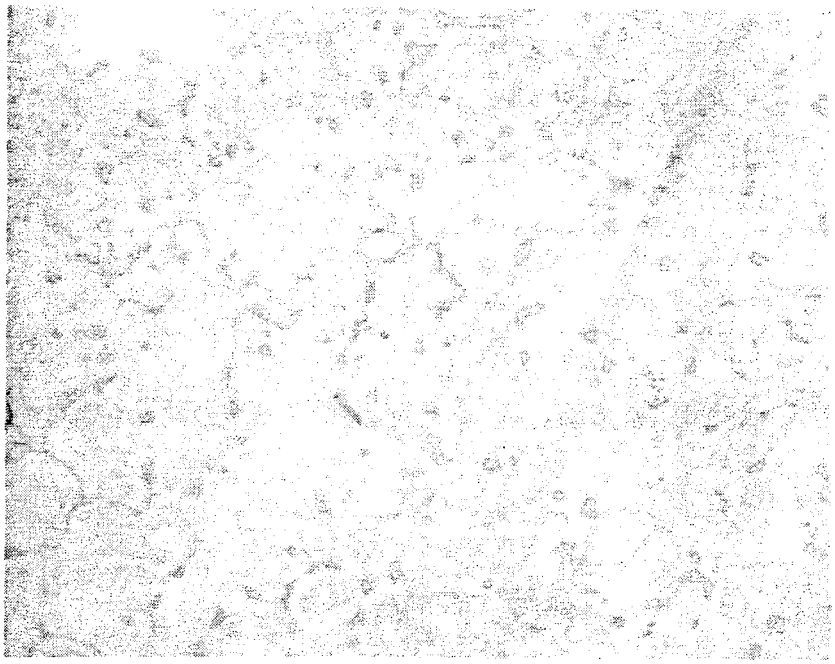
FIG. 1 is a photomicrograph showing the grain structure of an alloy of the present invention prepared in accordance with Example 1.

In accordance with the invention, it has been found that the addition of mischmetal to bismuth-containing copper alloys provides alloys which can be readily substituted for leaded brass alloys in the foundry. More particularly, the alloys of the invention can be substituted for CDA (Copper Development Association) alloys C83600 and C84400, two of the most widely used leaded alloys in the plumbing industry.

Mischmetal is a rare earth alloy. One such alloys contains 3% iron and 96% rare earth metals and 1% residuals. The rare earth content consists of 48–53% (typically 51.50%) cerium, 20–24% (typically 21.4%) lanthanum, 18–22% (typically 19.5%) neodymium, 4–7% (typically 5.4%) praseodymium and 1% other rare earth metal. Mischmetal, or its rare earth equivalent, may be used in the present invention. By rare earth equivalent it is meant alloys containing one or any combination of cerium, lanthanum and neodymium or an equivalent rare earth element.

While it is a principal object of the invention to provide alloys which are lead free or substantially lead free, because lead-free scrap is more expensive than leaded scrap, those skilled in the art may elect to use quantities of leaded scrap in preparing their alloys to reduce expense. While this at least partially defeats the environmental and occupational advantages of removing lead, the addition of mischmetal in accordance with the invention is nevertheless effective in alloys containing small amounts of lead. Hence, while the invention is directed to alloys which are lead-free or which contain lead at the level of an incidental impurity, it will not circumvent the invention to incorporate small amounts of lead, e.g., up to 4% in the alloy.

In addition to containing bismuth, tin, copper, zinc, nickel and mischmetal in the amounts previously indicated, the invention is open to the inclusion of those elements occurring in conventional casting alloys. These include iron (typically in an amount of up to 0.3%), antimony (typically in an amount of up to 0.25%), sulphur (typically in an amount of up to 0.08%), phosphorous (typically in an amount of up to 0.05%), aluminum (typically in an amount of up to 0,005%), and silicon (typically in an amount of up to 0.005%). These additives are generally present in a total amount less than 1%.

Certain alloys in accordance with the invention are modifications of CDA alloys 83600, 84400 and 84800 which include up to 1% mischmetal and contain bismuth instead of lead. More particularly, an alloy substitute for C83600 in accordance with the present invention may contain 84–86% copper, 4–6% tin, 4–6% zinc, 4–6% bismuth, 1% nickel, and 0.1–1% mischmetal. An alloy substitute for C84400 may contain 78–82% copper, 2.3–3.5% tin, 7–10% zinc, 6–8% bismuth, 1% nickel and 0.1–1% mischmetal. An alloy substitute for C84800 may contain 75–77% copper, 2–3% tin, 5.5–7% bismuth, 13–17% zinc, 1% nickel and 0.1–1% mischmetal.

A low bismuth alloy in accordance with the invention may contain about 3 to 4% tin, about 6 to 8% zinc, about 0.6 to 0.9% bismuth, about 0.1 to 1% mischmetal and about 0.5 to 1% nickel and the balance copper and incidental impurities. A preferred low bismuth alloy contains 3.25 to 3.5% tin and 0.55 to 0.7% nickel.

In accordance with another embodiment of the invention, a low lead or lead-free nickel silver substitute is provided. One such alloy is a modification of CDA alloy 97300 and contains about 1.5 to 3.0% tin, about 0.1 to 7% bismuth, about 17 to 25% zinc, about 1.5% iron, about 11 to 14% nickel, about 0.5% manganese, about 0.1 to 1% mischmetal and the balance copper and incidental impurities.

In selected applications, it may be desirable to provide a low tin alloy. Tin can be reduced to levels less than 1% and replaced with up to about 8% nickel.

The invention is illustrated in more detail by the following non-limiting Examples:

EXAMPLE 1

A lead-free brass alloy analogous to CDA C84400 having the following composition: 3.75% tin, 0.05% lead, 3.30% bismuth, 9.33% zinc, 0.1% mischmetal and the balance copper was prepared as follows:

A copper-based, lead-free scrap containing tin and zinc as principal alloying elements was melted in an induction furnace at about 2000° F. When the scrap was totally molten, it was degassed and deoxidized using standard foundry practices. Phosphor copper shot 15% was added to deoxidize the metal. Metallic bismuth was added and stirred. After a few minutes of agitation, the mischmetal was introduced. The molten mixture was skimmed clean and poured into cast iron molds at 2100° F. and the alloy was allowed to cool. Sections of 2 different 20-25 pound ingots were tested to determine the mechanical properties as cast with the following results:

| | Tensile Strength | Yield Strength | % Elongation |
|---|---|---|---|
| Ingot 1 | 33,593 psi | 18,842 psi | 15.3 |
| Ingot 2 | 33,247 psi | 18,660 psi | 16.2 |

FIG. 1 shows a grain refinement of this alloy with uniform distribution of bismuth in the copper matrix at 200 magnification after etching with ammonium persulfate.

The Ingots were remelted in a gas-fired furnace without any cover of flux. At 2100° F., the crucible containing the molten metal was skimmed clean and deoxidized with phosphor copper shots. At this point, the entire metal was poured into green sand molds to produce hundreds of castings with a wide variety of thicknesses of the type usually used in plumbing fittings.

EXAMPLE 2

Using the procedure of Example 1, a lead-free brass alloy similar to CDA C83600 was prepared from a mixture of a lead-free scrap containing tin and zinc as the principal alloying elements and 90/10 copper-nickel scrap. This scrap mixture after becoming molten was degassed and deoxidized and finally refined with mischmetal. It was then skimmed clean and poured into cast iron ingot molds with the following composition: 3.51% tin, 0.14% lead, 2.92% bismuth, 5.16% zinc, 0.41% nickel, 0.2% mischmetal and the balance copper. To minimize cost, tin was deliberately figured approximately half a percent lower than sand cast alloy CDA C83600. A rectangular section of an ingot was sliced and tested mechanically as cast with the following results:

| | |
|---|---|
| Tensile Strength | 34,190 psi |
| Yield Strength | 17,168 psi |
| % Elongation | 21.6 |

Figure 2:
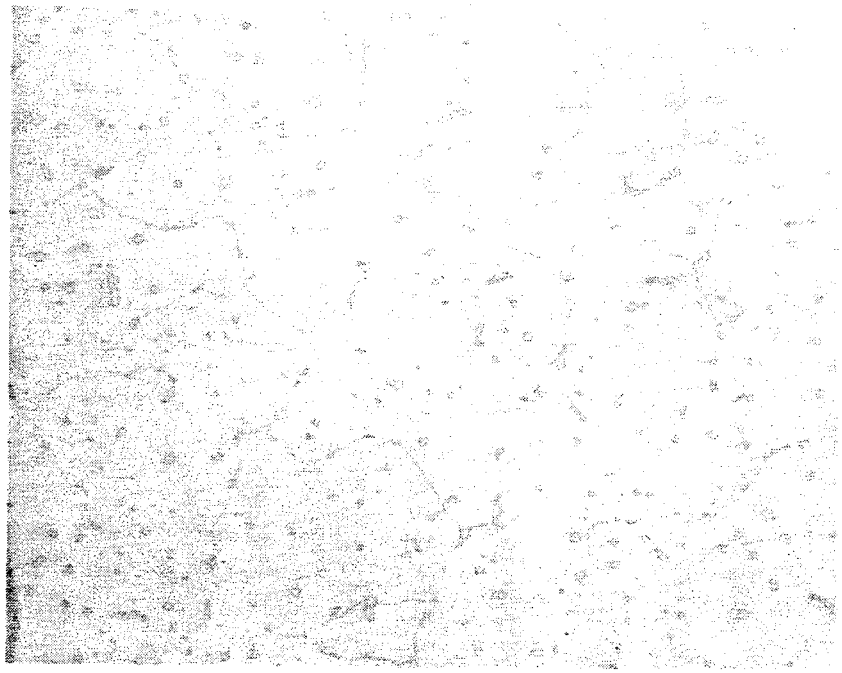
FIG. 2 is a photomicrograph of an alloy of the invention prepared in accordance with Example 2.

A small section of the ingot was polished, etched with ammonium persulfate, and photomicrographed at 200 magnification to provide FIG. 2.

Figure 3:
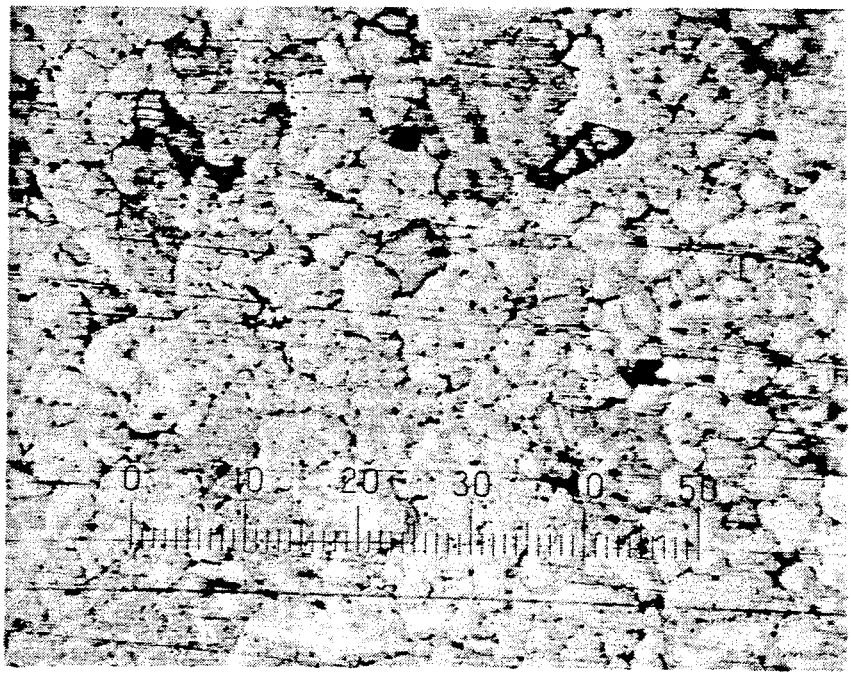
FIGS. 3 is a photomicrographs showing the grain structure of a casting prepared from the alloy of Example 2.

This alloy was sand cast in the same manner as Example 1 in order to produce a great variety of plumbing brass fittings. The test results were comparable to Example 1. In addition, a small section was prepared from a large casting etched with ammonium persulfate and the microstructure was studied at 75X magnifications to provide (FIG. 3).

EXAMPLE 3

Figure 4:
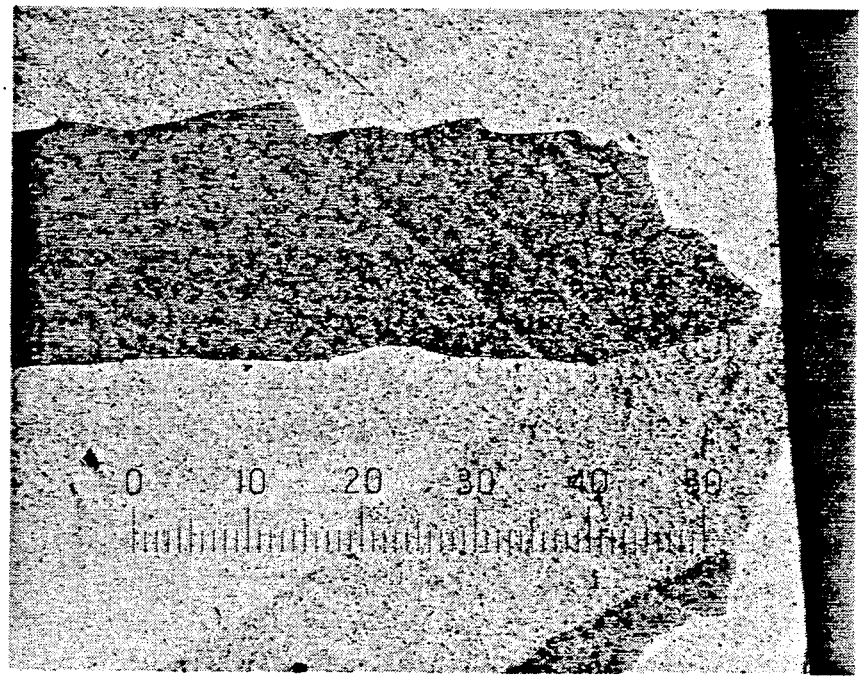
FIG. 4 is a photomicrograph showing the grain structure of an alloy nominally containing 90% copper and 10% zinc.
Figure 5:
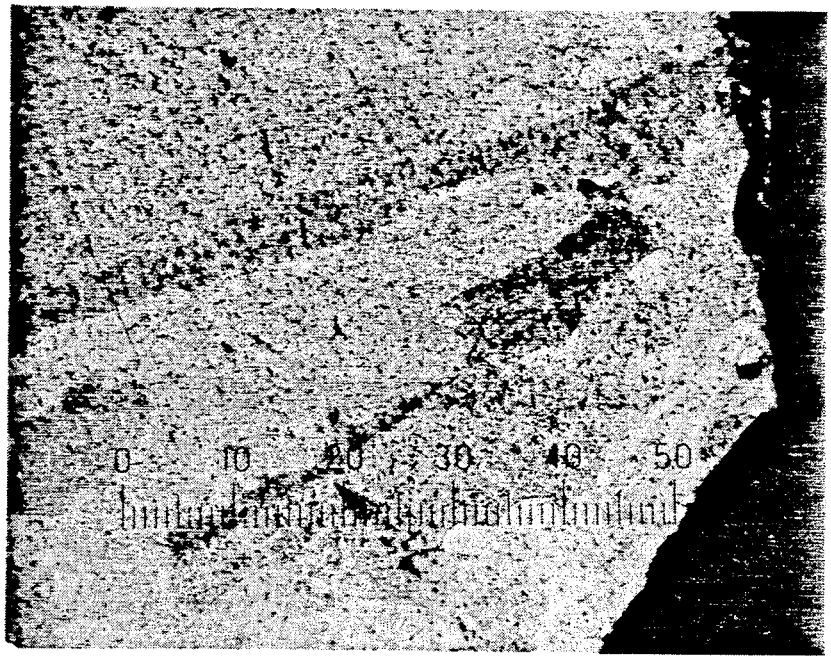
FIG. 5 is a photomicrograph showing the grain structure for the alloy of FIG. 4 modified to include 2% bismuth disclosed as in Example 3.
Figure 6:
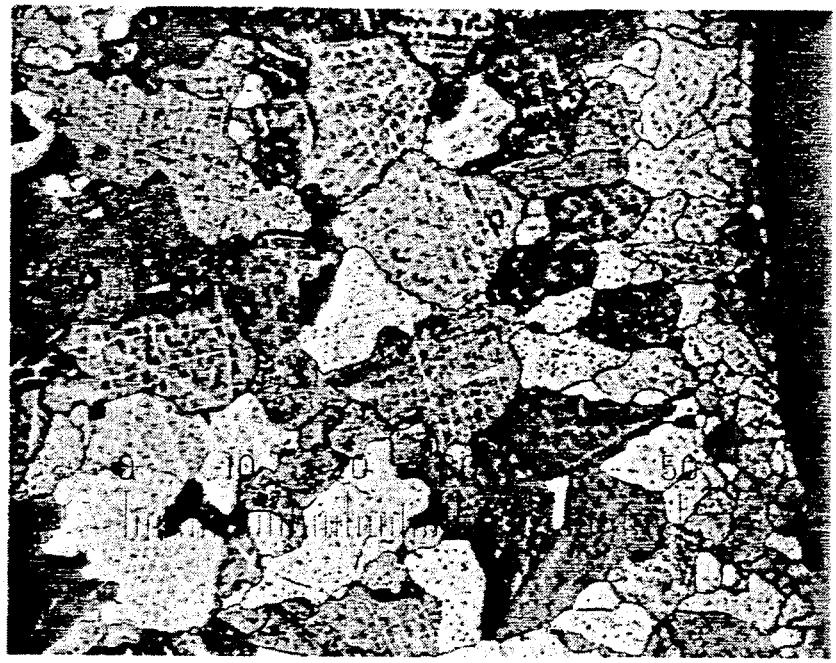
FIG. 6 is a photomicrograph showing the grain structure of the alloy of FIG. 5 further modified to include mischmetal as disclosed in Example 3.

This Example demonstrates the effect of the addition of mischmetal on the grain structure of bismuth alloys. Copper alloy CDA C83400, which is essentially an alloy of 90% copper and 10% zinc with trace amounts of tin and lead was remelted. When the metal was molten, a portion was poured into cast iron molds. This sample was eventually polished and etched with ammonium persulfate and a photomicrograph was made at 75X magnification to provide FIG. 4. Another portion of the alloy was modified by the addition of 2% bismuth and poured into cast iron molds, etched and photomicrographed at 75X to provide FIG. 5. A third portion of the alloy was modified with 2% bismuth and 1.0% mischmetal and poured, etched and photomicrographed in the same manner to provide FIG. 6. A comparison of FIGS. 4, 5 and 6 clearly reveals the dramatic change in the size of the grains after the introduction of mischmetal into the bismuth-containing alloy.

EXAMPLE 4

Using the procedure of Example 1, a copper based lead free scrap containing tin and zinc as principal alloying elements was melted with copper-nickel scrap in a gas fired furnace. Eventually this mixture was alloyed with bismuth and mischmetal was introduced. The molten mixture was skimmed clean and poured into cast iron ingot molds at 2100° F. with the following composition: 3.53 tin, 0.13% lead, 0.60% bismuth, 7.45% zinc, 0.41% nickel, 0.2% mischmetal and the balance copper.

The ingots prepared from the above alloy were remelted in a gas fired furnace without any cover of flux. At 2200° F., the molten metal was skimmed clean and deoxidized with 15% phosphor copper shot. A number of castings used used in plumbing industry were made by pouring the metal into green sand molds. In addition, four test bars were poured into green sand molds in accordance with ASTM specification B 208. The results below show that the test bars provide tensile strength, yield strength, and elongation analogous to CDA 83600 Alloy and CDA 84400 Alloy.

| | Tensile Strength | Yield Strength | % Elongation |
|---|---|---|---|
| Test Bar 1 | 33,813 psi | 14,947 psi | 28.2 |
| Test Bar 2 | 33,325 psi | 14,887 psi | 28.8 |
| Test Bar 3 | 33,280 psi | 15,067 psi | 31.5 |
| Test Bar 4 | 31,692 psi | 14,947 psi | 24.2 |

Having described the invention in detail and by reference to preferred embodiments thereof, it will be apparent that modifications and variations are possible without departing from the scope of the invention defined in the appended claims.

What is claimed is:

1. A cast alloy consisting essentially of about 0.1 to 7% bismuth, about 2 to 6% tin, about 4 to 10% zinc, about 0.5 to 1% nickel, and about 0.1 to 1.0% mischmetal and the balance copper and incidental impurities.

2. The alloy of claim 1 wherein said alloy further contains an element selected from the group consisting of iron, antimony, sulphur, phosphorous, aluminum and silicon wherein the total combined amount of said further elements is less than 1%.

3. The alloy of claim 1 wherein said alloy is lead-free but for incidental impurities.

4. The alloy of claim 1 wherein said alloy consists essentially of 84–86% copper, 4–6% tin, 4–6% zinc, 4–6% bismuth, 0.5–1% nickel, and 0.1–1% mischmetal.

5. The alloy of claim 1 wherein said alloy consists essentially of 78–82% copper, 2.3–3.5% tin, 7–10% zinc, 6–7% bismuth, 0.5–1% nickel, and 0.1–1% mischemtal.

6. The alloy of claim 1 wherein said mischmetal contains cerium, lanthanum, and neodymium as its principal components.

7. The alloy of claim 1 containing 0.1 to 1% bismuth.

8. The alloy of claim 1 wherein said bismuth is present in an amount of about 0.6 to 1.8%.

9. The alloy of claim 8 wherein said alloy consists essentially of about 3 to 4% tin, about 6to 8% zinc, about 0.6 to 0.9% bismuth, about 0.1 to 1% mischmetal and about 0.5 to 1% nickel.

10. The alloy of claim 9 wherein said alloy consisting essentially of said tin in an amount of about 3.25 to 3.5% and said nickel in an amount of about 0.55 to 0.7%.

* * * * *

UNITED STATES PATENT AND TRADEMARK OFFICE

CERTIFICATE OF CORRECTION

PATENT NO. : 5,330,712
DATED : July 19, 1994
INVENTOR(S) : Akhileshwar R. Singh

It is certified that error appears in the above-indentified patent and that said Letters Patent is hereby corrected as shown below:

Column 6, Claim 5, lines 67-68 change "mischemtal" to --mischmetal--.
Column 7, Claim 8, line 6 change "1.8%" to --1.5%--.
Column 8, Claim 9, line 1 add a space between "6to", to --6 to--.

Signed and Sealed this

Twenty-seventh Day of September, 1994

*Attest:*

Bruce Lehman

BRUCE LEHMAN

*Attesting Officer*

*Commissioner of Patents and Trademarks*